United States Patent [19]

Essig

[11] Patent Number: 4,890,462

[45] Date of Patent: Jan. 2, 1990

[54] KNITTED FABRIC

[75] Inventor: Horst Essig, Frickenhausen, Fed. Rep. of Germany

[73] Assignee: H. Stoll GmbH & Co., Fed. Rep. of Germany

[21] Appl. No.: 241,117

[22] Filed: Sep. 6, 1988

[30] Foreign Application Priority Data

Sep. 4, 1987 [DE] Fed. Rep. of Germany ..... 3729662

[51] Int. Cl.[4] ..... D04B 7/04

[52] U.S. Cl. ..... 66/196; 66/200; 66/197

[58] Field of Search ..... 66/196, 197, 200, 172

[56] References Cited

U.S. PATENT DOCUMENTS 3,727,659 4/1973 Shuford ..... 66/170

*Primary Examiner*—Ronald Feldbaum

*Attorney, Agent, or Firm*—Larson and Taylor

[57] ABSTRACT

In knitted fabric there is provided at least one area contained by a tension thread which is tied by means of tuck loops into individual stitches of the adjoining fabric in such a way that its two ends lie on the same edge side of the contained fabric area. As a result of a pull on the ends of the tension thread the edge of the fabric area contained by the tension thread is pulled together and thereby the fabric area is curved out of the plane of the fabric as a whole or divided into individual segments.

12 Claims, 2 Drawing Sheets

KNITTED FABRIC

The invention relates to a knitted fabric of special design.

The object on which the invention is based is to design a knitted fabric with a pattern not hitherto known.

According to the invention, this object is achieved by the provision of at least one fabric area contained by a tension thread or yarn which, before the first stitch row and after the last stitch row of the fabric area is tied by means of tuck loops into individual stitches of the adjoining fabric and/or into individual stitches of the fabric area contained by it, in such a way that its two ends are located on the same edged side of the limited fabric area and, as a result of a pull on the two ends of the tension thread, the fabric area contained by it can be curved out of the fabric plane.

It is known from woven fabrics to weave in a pull tape or a pull thread, by means of which the fabric, for example a braiding tape for curtains can then subsequently be gathered. Also, it is possible subsequently to pull into knitted articles cords or tapes, by means of which a knitted article can be pulled together, for example, in its edge or waist region. However, a fabric designed according to the invention differs from, this in that, any relevant region within the fabric is surrounded continuously by a tension thread, only the edge of this fabric region is pulled together and the knit region surrounded by the tension thread is curved to form a three-dimensional pattern. At the same time, as a result of a specific guidance of the tension thread in the fabric and/or the formation and pattern of the fabric region surrounded by the tension thread, specific three-dimensional shape patterns, such as, for example, roses or knobs, can be produced.

A fabric designed according to the invention can be made on a flat knitting machine or even on a reciprocating knitting machine. In particular, a two-bed flat knitting machine with yarn guides which can be released and picked up by the carriage at any desired point is suitable. The tension yarn can here either be inserted into tuck loops, on both sides of the patterned area, only by means of needles of one of the two needle beds, or else be processed to form tuck loops alternately by means of needles of the two needle beds on one side. In the former case, when a pull is exerted on the ends of the tension thread, a curving of the entire surrounded fabric area occurs. In the second case, the tension thread also causes constrictions within the surrounded fabric area and the division of the latter into individual curved regions, with the result that the individual knobs or roses mentioned by way of example can be formed.

A fabric designed according to the invention makes it possible to form various three-dimensional patterns, the effect of which can be increased further by means of a pattern within the curved fabric area or a special pattern of the non-gathered fabric area surrounding the curvable fabric area. At the same time, advantageously, the fabric area contained by the tension thread can be patterned with a different thread or different threads from the adjoining fabric or differently in terms of colour and/or shape. The tension thread may differ in terms of thickness and/or type and/or colour from the threads used for making the fabric area contained by it, thus not only making it easier to pick up its ends for curving the fabric area, but providing the possibility of obtaining an additional pattern effect, for example by means of a final looping with the ends of the tension thread.

The fabric area delimited by the tension thread can be made single-faced or double-faced. In a preferred process for forming the fabric on a flat knitting machine, during the formation of a single-faced or double-faced fabric, between two randomly selectable points of the carriage travel, a tension thread can be inserted, at intervals, into individual needles of the first needle bed and/or second needle bed in the tuck position by means of one of the thread guides, in the first direction of adjustment of the carriage, subsequently, within the carriage travel zone defined by the two selected points, at least one pattern thread can be fed by means of at least one other thread guide and processed by all or individual needles of the carriage-travel zone to form plain or rib stitches, and finally, in the second direction of movement of the carriage, up to the first selected carriage-travel point the tension thread can be inserted, at intervals, into individual needles of the first needle bed in the tuck position by means of the thread guide assigned to it.

Two exemplary embodiments of the subject of the invention are explained in detail below by way of example of the accompanying drawings of a thread run.

Figure 1:
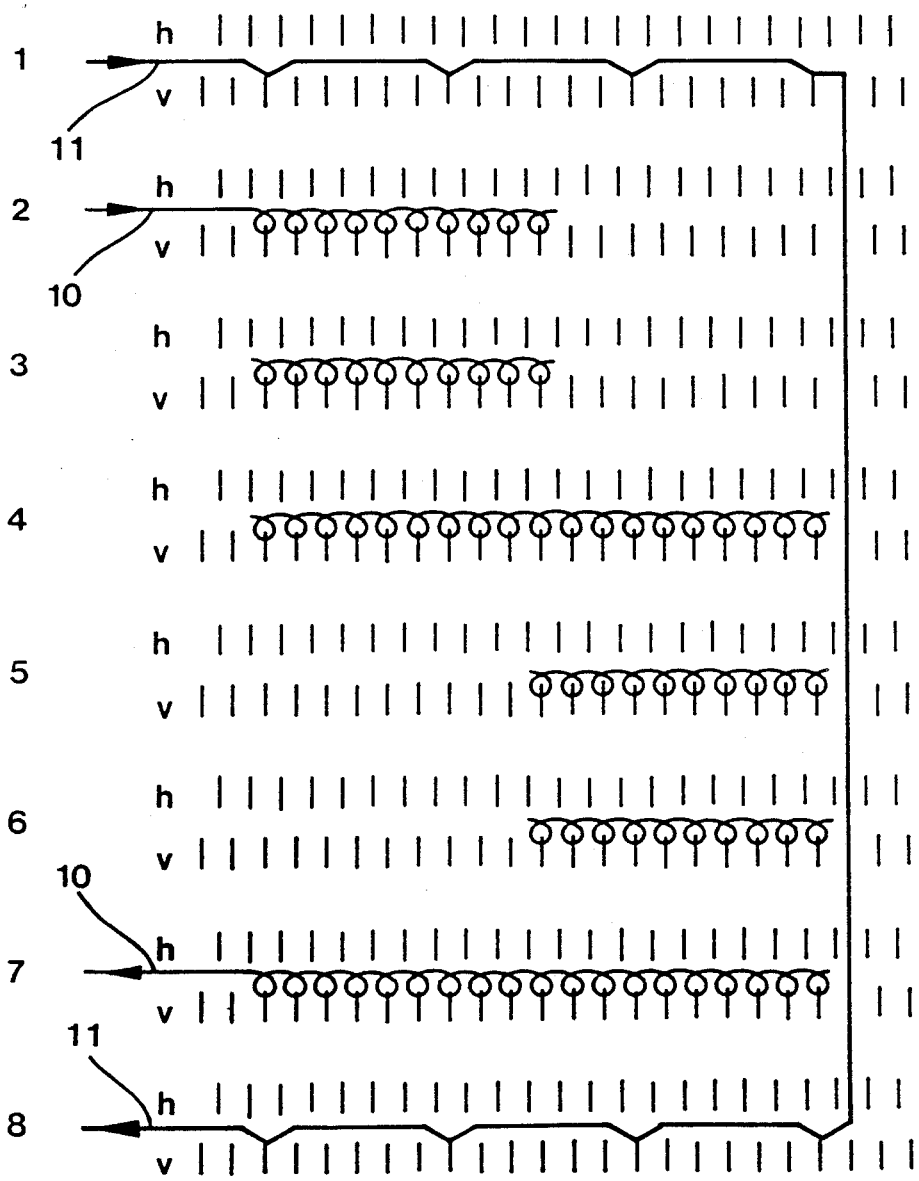
FIG. 1 illustrates yarn structure for making a fabric which is divided into individual areas and which can be curved as a whole by means of a tensioning yarn.

In the drawings, the double rows arranged below one another and consisting of dashes symbolize the needles of the flat knitting machine. The double rows or courses are numbered consecutively from the top downwards. Only the thread run of a pattern yarn 10, by means of which a contained area of the fabric is formed, and that of a tension yarn 11 surrounding this limited area are in each case shown, but not the yarn or yarns, by means of which the surrounding knitted fabric is produced.

In the fabric area shown in FIG. 1, a tension yarn 11 represented by a thick line, coming from the left, is picked up by individual needles of the front needle bed v in a tuck position, that is to say is inserted into these needles to form tuck loops. At the same time, the needles can hold stitches of the basic knit (not shown). During the next stroke of the carriage, a pattern yarn or thread 10, coming from the left, is fed in the stitch row 2 and is processed by several mutually juxtaposed needles of the front needle bed v to form plain stitches. During the return movement of the carriage, a short stitch row 3 is formed by the same needles of the front needle bed v, and subsequently a longer stitch row 4 with double the length of the stitch rows 2 and 3 is formed by a larger number of needles of the front needle bed v. Thereafter, two further stitch rows 5 and 6 consisting of plain stitches are formed by means of the needles of the front needle bed v which were newly included for the stitch row 4. Finally, the fabric area is terminated as a result of the formation of a long stitch row 7 by means of the same needles which also formed the stitch row 4. Following this, during a movement of the carriage from right to left, the tension yarn 11 is once again inserted into individual needles of the front needle bed v to form tuck loops. The two ends of the tension yarn 11 in the stitch rows 1 and 8 are therefore both located on the same side of the fabric area extending over the stitch rows or courses 1 to 8.

Subsequently, the remaining fabric is produced further from yarns (not shown). After it has been completed, as a result of a pull on the two ends of the tension thread 11, the fabric area formed by the pattern yarn 10 is pulled together at its edge and thereby curved outwards out of the plane of the remaining fabric. At the same time, the stitch rows 2, 3 and 5, 6 form two individual mutually juxtaposed curves which are connected to one another by means of the stitch row 4. It goes without saying that the fabric area surrounded by the tension yarn 11 can comprise more than only 6 stitch rows. Also, it can be kept longer or shorter. The stitch rows 2 to 7 could also consist of rib stitches or partly of plain stitches and partly of rib stitches.

Figure 2:
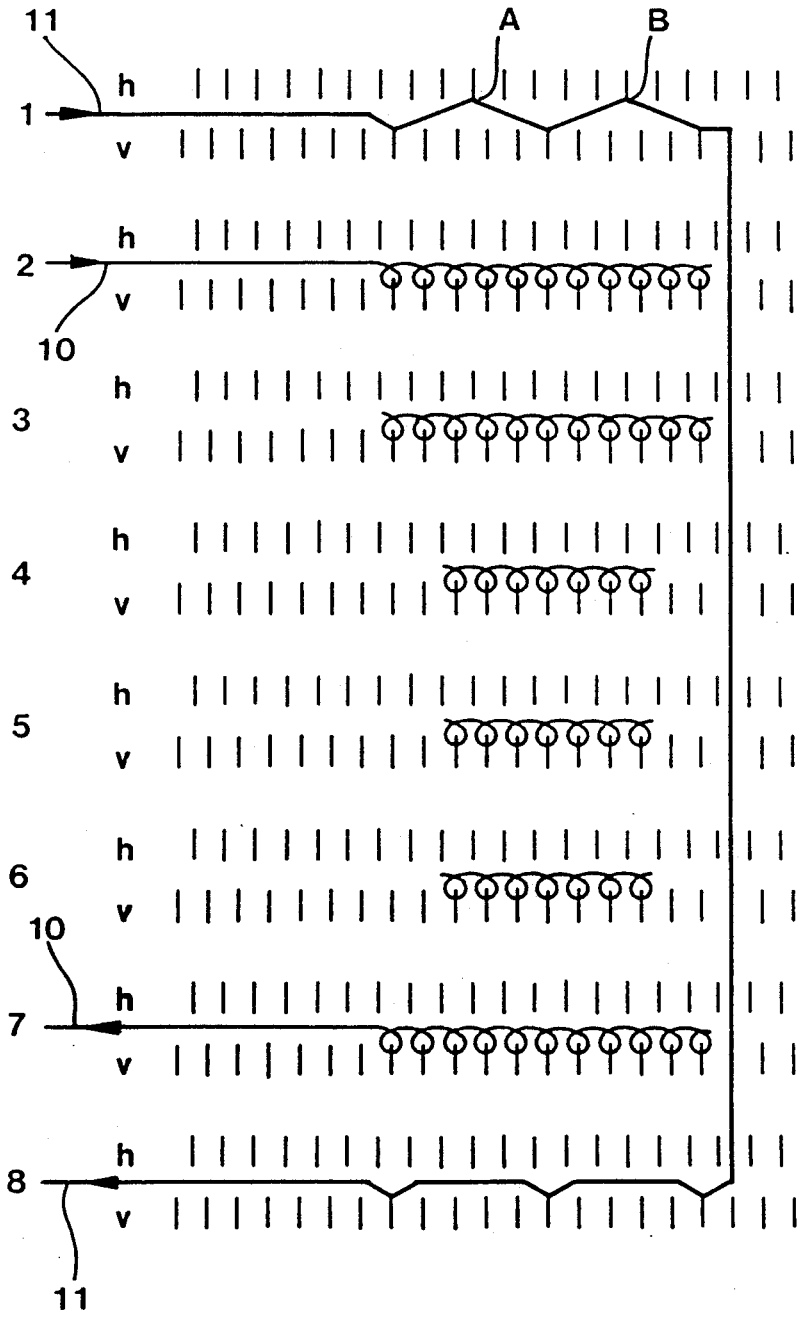
FIG. 2 illustrates a yarn structure for a fabric which can be curved by means of an inserted tensioning yarn so as to form individual knobs or burls.

In the embodiment illustrated in FIG. 2, in stitch row 1 the tension yarn 11 coming from the left is inserted both into individual needles of the front needle bed v and into individual needles of the rear needle bed h to form tuck loops. Subsequently, in the stitch rows 2 to 7, stitch rows of differing lengths and composed of plain stitches are knitted with a pattern thread 10 by needles of the front needle bed v. Finally, in the stitch row 8, the tension thread 11 is now again inserted from right to left to form individual tuck loops, this time only into individual needles of the front needle bed v. When a pull is exerted on the ends of the tension thread 11 which are once again located on the same side of the knitted fabric area formed, not only the edge of the area is pulled together, as in the described embodiment according to FIG. 1. At the points, designated by A and B in the stitch row 1, where tuck loops are formed by needles of the rear needle bed h, when a pull is exerted on the ends of the tension thread 11, there is also a constriction of the fabric area, so that the fabric formed by the pattern thread 10 is curved so as to be divided into three individual regions. According to the selected distribution of the tuck loops in the stitch row 1, any constriction patterns, for example roses, can thus be obtained on needles of the two needle beds.

I claim:

1. In a knitted fabric comprising at least one profiled fabric area, a tension thread bordering said fabric area, which tension thread before the first stitch row and after the last stitch row of said fabric area is tied by means of tuck loops into the fabric adjoining said area such that the two ends of the said tension thread are located on the same edge side of the said fabric area and, as a result of a pull on the two ends of the tension thread, the said fabric area contained thereby can be curved out of the plane of the fabric.

2. A fabric as claimed in claim 1 wherein the fabric area limited by the tension thread is made with at least one different thread from that of the adjoining fabric.

3. A fabric as claimed in claim 1 wherein the fabric area limited by the-tension thread is patterned according to colour and/or shape.

4. A fabric as claimed in claim 1 wherein the tension thread differs in terms of thickness and/or type and/or colour from the threads used for making the fabric area limited by said tension thread.

5. A fabric as claimed in claim 1 wherein the fabric area bordered by the tension thread is made single-faced.

6. A process for making a fabric on a flat knitting machine having two needle beds and, also thread guides which can be released and picked up by the carriage of the machine at any desired point, wherein, during the formation of a fabric between two randomly selectable points of the carriage travel, there is inserted a tension thread at intervals into individual needles of at least one needle bed of said two needle beds in the tuck position by means of one of said thread guides in the first direction of movement of the carriage, wherein subsequently, within the zone of the carriage travel defined by said two selectable points, at least one pattern thread is fed by means of at least one other thread guide and is processed by, needles within said zone of carriage travel to form stitches; and wherein in the second direction back to the first of said selectable points of carriage movement the tension thread is inserted at intervals into individual needles of the first of said two needle beds in the tuck position by means of the said one of the thread guide assigned to the tension thread.

7. A fabric as claimed in claim 1, wherein the fabric is a double-faced fabric and said tension thread is inserted on both sides of the fabric in tuck loops on one of the two fabric faces.

8. A fabric as claimed in claim 1, wherein said fabric is a double-faced fabric and said tension thread is inserted in tuck loops, wherein on one side of the fabric area said tuck loops are formed on one of the two fabric faces, and on the other side of the fabric area said tuck loops are formed on both fabric faces.

9. A process as claimed in claim 6 wherein during the formation of a single-faced fabric said tension thread is inserted at intervals into individual needles of said first needle bed.

10. A process as claimed in claim 6 wherein during the formation of a double-faced fabric said tension thread is inserted at intervals into individual needles of said first and of the second needle bed.

11. A process as claimed in claim 6 wherein said pattern thread is processed by all needles within said zone of carriage travel to form plain stitches.

12. A process as claimed in claim 6 wherein said pattern thread is processed by individual needles within said zone of carriage travel to form rib stitches.

* * * * *